US009993844B2

(12) United States Patent
Jenkins et al.

(10) Patent No.: US 9,993,844 B2
(45) Date of Patent: Jun. 12, 2018

(54) REPLACEABLE GRIZZLY SCREEN MEMBER TIPS

(71) Applicant: CRUCIBLE, LLC, Birmingham, AL (US)

(72) Inventors: Michael S. Jenkins, Naperville, IL (US); Gary W. Anderson, Leeds, AL (US)

(73) Assignee: CRUCIBLE, LLC, Birmingham, AL (US)

( * ) Notice: Subject to any disclaimer, the term of this patent is extended or adjusted under 35 U.S.C. 154(b) by 113 days.

(21) Appl. No.: 15/152,215

(22) Filed: May 11, 2016

(65) Prior Publication Data

US 2017/0326595 A1 Nov. 16, 2017

(51) Int. Cl.
*B07B 1/46* (2006.01)
*B07B 1/12* (2006.01)

(52) U.S. Cl.
CPC ..... *B07B 1/12* (2013.01); *B07B 1/4627* (2013.01)

(58) Field of Classification Search
CPC ..... B07B 1/12; B07B 1/4618; B07B 1/4645; B07B 2201/02
USPC ..... 209/393, 395, 675
See application file for complete search history.

(56) References Cited

U.S. PATENT DOCUMENTS 760,590 A * 5/1904 Vodra ..... B07B 1/12 209/393
1,187,238 A * 6/1916 Beaumont ..... B07B 1/48 209/257
1,491,802 A * 4/1924 Irwin ..... B07B 13/00 209/394
3,241,671 A * 3/1966 Brauchla ..... B07B 1/12 209/243
3,261,108 A * 7/1966 Rossi ..... B07B 1/12 34/164
3,971,716 A * 7/1976 Foreman ..... B07B 1/16 198/775
4,361,240 A * 11/1982 Davis ..... B07B 1/12 209/674
5,322,170 A * 6/1994 Hadden ..... B07B 1/005 209/314
5,816,412 A * 10/1998 Bokor ..... B07B 1/12 209/326
5,901,857 A * 5/1999 Schurman ..... B07B 1/12 209/395
6,116,428 A * 9/2000 Loshe ..... B07B 1/12 209/319
7,383,957 B2 * 6/2008 Cox ..... B07B 1/12 209/395
8,708,154 B1 * 4/2014 Holmberg ..... B07B 1/145 209/393
2008/0110807 A1 * 5/2008 Goguen ..... B07B 1/12 209/394
2010/0059416 A1 * 3/2010 Snow ..... B07B 1/12 209/414

* cited by examiner

*Primary Examiner* — Joseph C Rodriguez
(74) *Attorney, Agent, or Firm* — David G. Rosenbaum; Benjamin D. Rotman; Rosenbaum IP, P.C.

(57) ABSTRACT

A grizzly screen member assembly with a replaceable tip end. The grizzly screen member assembly comprises an elongate base member and a replaceable tip member coupled removably coupled to the replaceable tip member. The elongate base member may be coupled to a panel and assembled into a grizzly feeder system or coupled to the grizzly feeder system itself.

18 Claims, 16 Drawing Sheets

REPLACEABLE GRIZZLY SCREEN MEMBER TIPS

BACKGROUND OF THE INVENTION

The present invention pertains generally to the field of grizzly feeders used in mining and construction industries. Grizzly feeders act as separators or filters and aid in the process of separating large rock from fine material. More particularly this invention relates to the construction of the separating elements within grizzly feeders known as "grizzly screen members."

As indicated in U.S. Pat. No. 3,261,108A, a grizzly feeder is a device having a deck or panel of longitudinally spaced inclined bars ("grizzly screen members") used in the mining and construction industries for separating relatively large size particles of material from particles of smaller sizes. A grizzly feeder is used for high volume scalping of aggregates, ores, coal etc., ahead of crushers, washers or similar equipment. Grizzly screen members are traditionally welded onto a panel or frame within a grizzly feeder.

The prior art teaches that the particles, as mentioned above, are fed onto a vibrating grizzly feeder and begin to traverse down the inclined grizzly screen members via the gravity and the vibration force. Particles smaller than the longitudinal space between two grizzly screen members fall between the grizzly screen members and are sifted out, while particles that are larger than the longitudinal space do not fall between the grizzly screen members and traverse all the way down the bars to the crusher.

For various grizzly feeder applications, grizzly screen members themselves have been designed with different shapes, sizes, and materials such as cast Manganese, alloyed steel, and chromium carbide. The prior art has discloses grizzly screen members with a proximal and distal end, the proximal end being welded at the top of the incline, while the distal end is that the base of the incline. Typically the overall width of the grizzly screen members taper from a wider proximal end to a narrower distal end. The prior art has also discloses grizzly screen members with a T-Shaped, triangular, trapezoidal, pentagonal, and other inventive polygonal cross-sections all designed for specific mining and crushing operations.

Grizzly screen members are considered consumable items which wear out from the abrasion and impact of the particles traversing down the panels. Despite the particular material and cross-sectional designs of individual grizzly screen members, due to the nature of the operation of the grizzly feeder and the way particles traverse down the panels and into the crushers, grizzly screen members typically wear down and or fail resulting in the need for repair or replacement. The distal end or discharge end, which can vary in length, but in some instances is the last 18-24 inches of each grizzly screen member, depending upon the size and style of grizzly, receives the most wear and fails sooner than the other sections of the grizzly screen member. When the grizzly screen members wear down in size, the filtered material is not properly sized, thus resulting in loss of production.

Replacement or repairs of a single grizzly screen member or panel is costly and labor intensive. Repairs are typically performed by manual weld buildup of the worn-out ends of individual grizzly screen members, while replacement involves removing and replacing individual screen members or entire panels. Both replacement and repair can result in significant down time of the grizzly feeder leading to significant downtime in the mining operation in general. The present invention addresses both of these shortcomings of the current prior art grizzly screen member variations.

SUMMARY OF THE INVENTION

The present invention relates to an individual grizzly screen member assembly and panel assembly with a replaceable tip component. A replaceable tip component is especially suitable for quickly and easily replacing the area of the grizzly screen member that wears down and fails the fastest. The replaceable tip component is configured to engage with a base component and is secured to the base component. When the replaceable tip has worn down to the point of ineffectiveness or failure, the bolts are removed, and the replaceable tip is disengaged from the base component and replaced with a new replaceable tip. The replaceable tip is thus configured to be removable from the base component and replaceable with a new replaceable tip by recoupling the replaceable tip to the base component.

One advantage of the present assembly is that the worn discharge portion of the grizzly screen member can be quickly removed and replaced mechanically with standard fasteners or bolts instead of being repaired or replaced through a more time consuming and more costly welding process.

An additional advantage is that replacing just the replaceable tip end preserves the rest of the bar that has not worn to the point of necessitating replacement. This increases the overall life of the grizzly screen member panel.

Another advantage of the present assembly is that the replaceable tip end can be made of a different material that may handle wear better than the rest of the grizzly screen member. This may increase overall wear life and decrease the cost of what it may have been to cast a single bar in a single alloy.

BRIEF DESCRIPTION OF THE DRAWINGS

In the accompanying figures, like elements are identified by like reference numerals among the several preferred embodiments of the present invention.

DETAILED DESCRIPTION OF THE PREFERRED EMBODIMENTS

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1A:
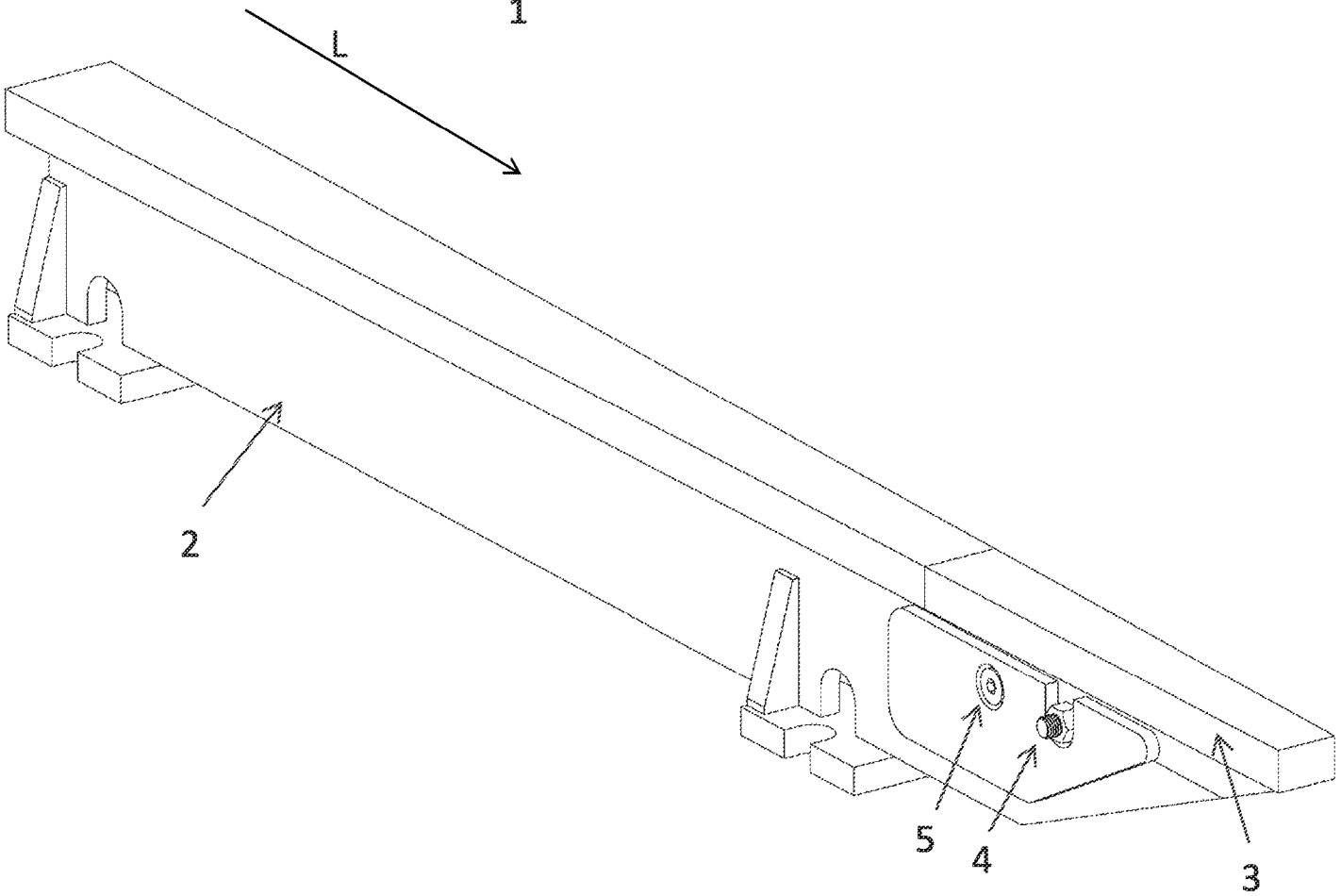
FIG. 1A is an isometric view of a single grizzly screen member assembly.
Figure 1B:
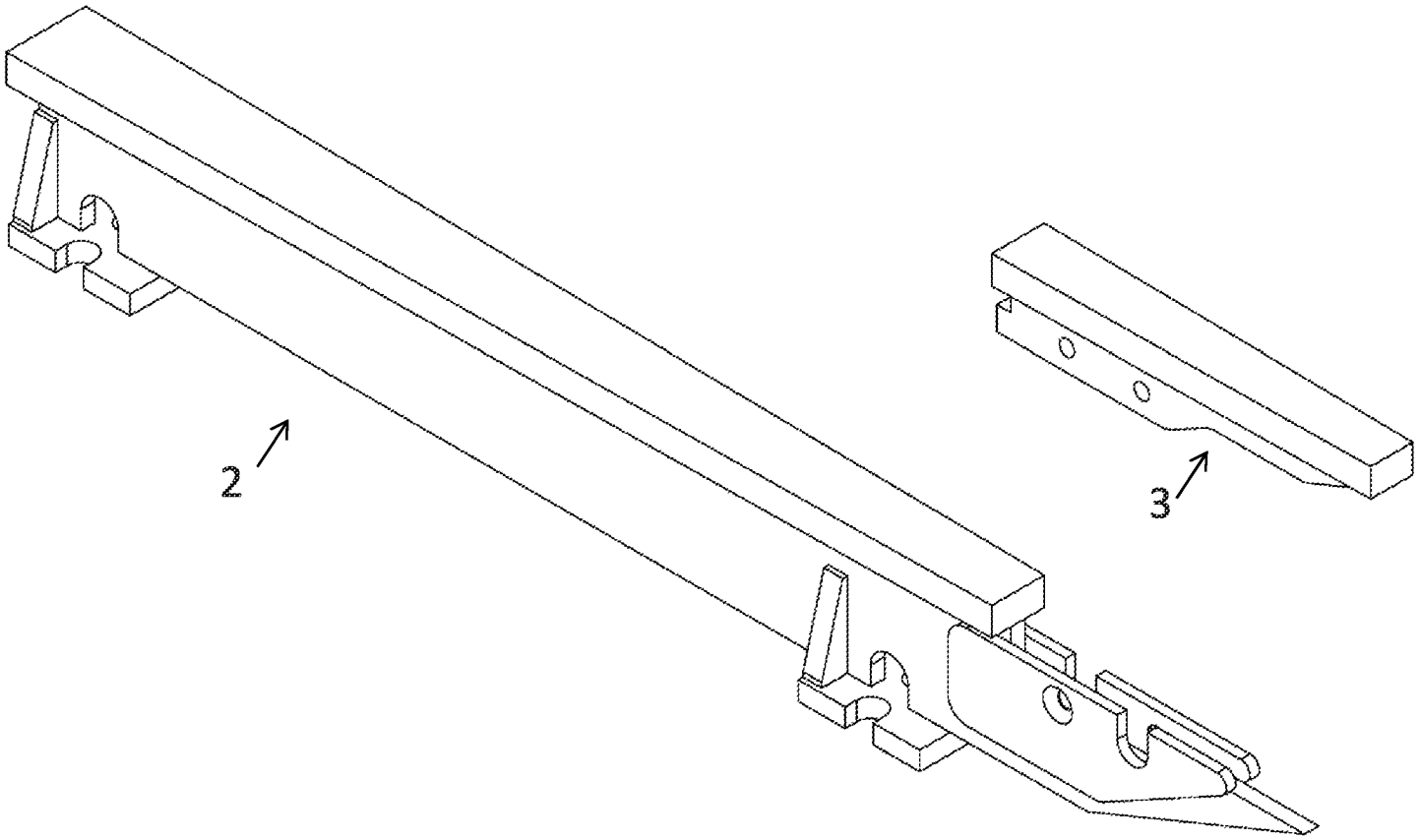
FIG. 1B is an exploded isometric view of a single grizzly screen member assembly.

With specific reference to the drawings, FIGS. 1A-1B, in their entireties represent a single grizzly screen member assembly 1. The assembly structure comprises two primary structural components, an elongate base component 2 with a proximal end, a distal end, a top surface member 6, and an elongate replaceable tip component 3 with a proximal tip end, a distal tip end, a tip top surface member 18 and a bottom tip surface. As further described in additional figures and this specification, the replaceable tip component 3 is secured to the base component 2, through a coupling shown as 4 and 5. The terms "proximal" and "distal" are intended to be positional terms relative to a longitudinal axis L of the elongate base component 2 or the replaceable tip component 3 and are relative to the direction of material flow over the elongate base component 2 and the replaceable tip component 3.

Figure 2A:
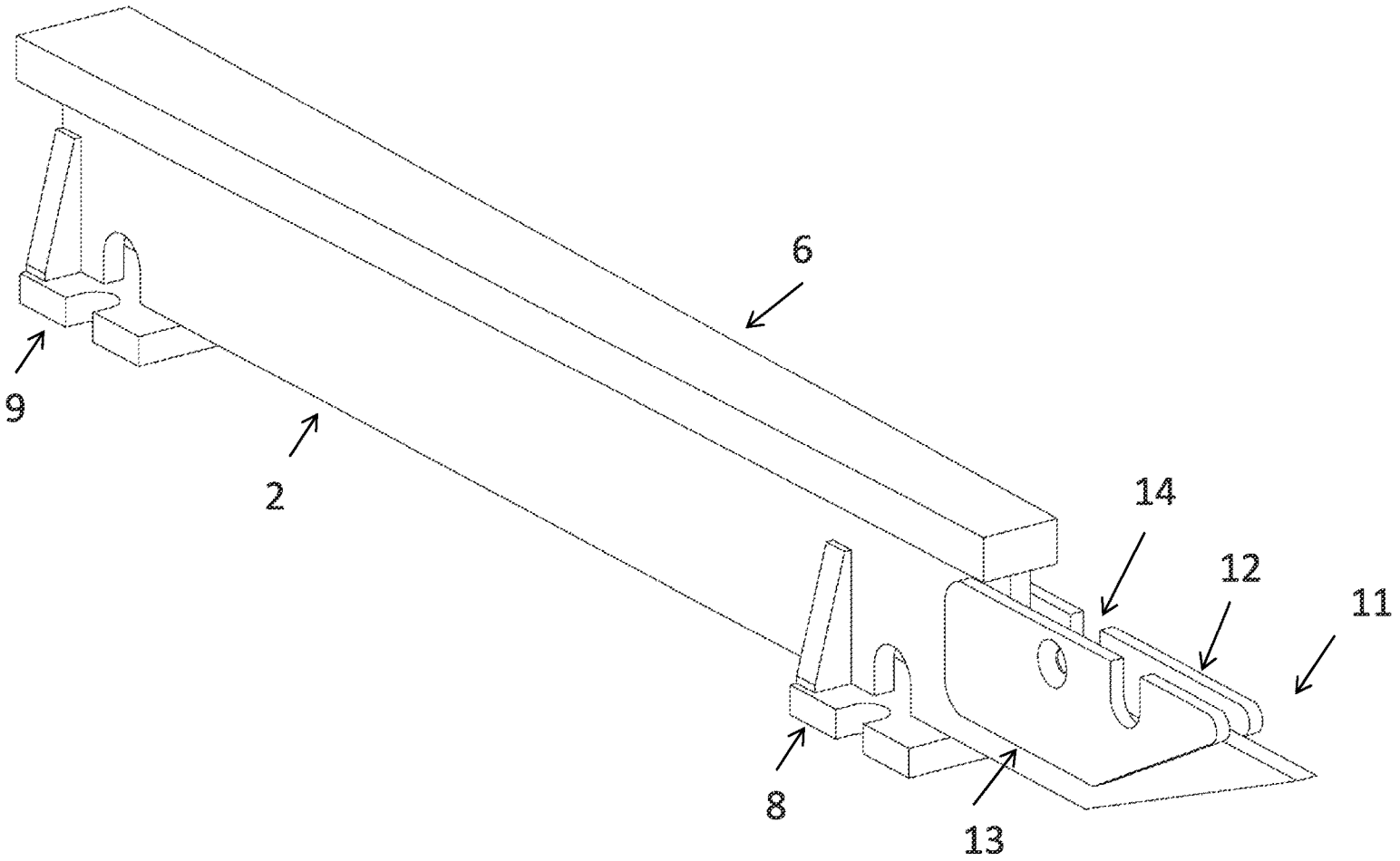
FIG. 2A is an isometric view of the base component of a single grizzly screen member assembly.
Figure 2B:
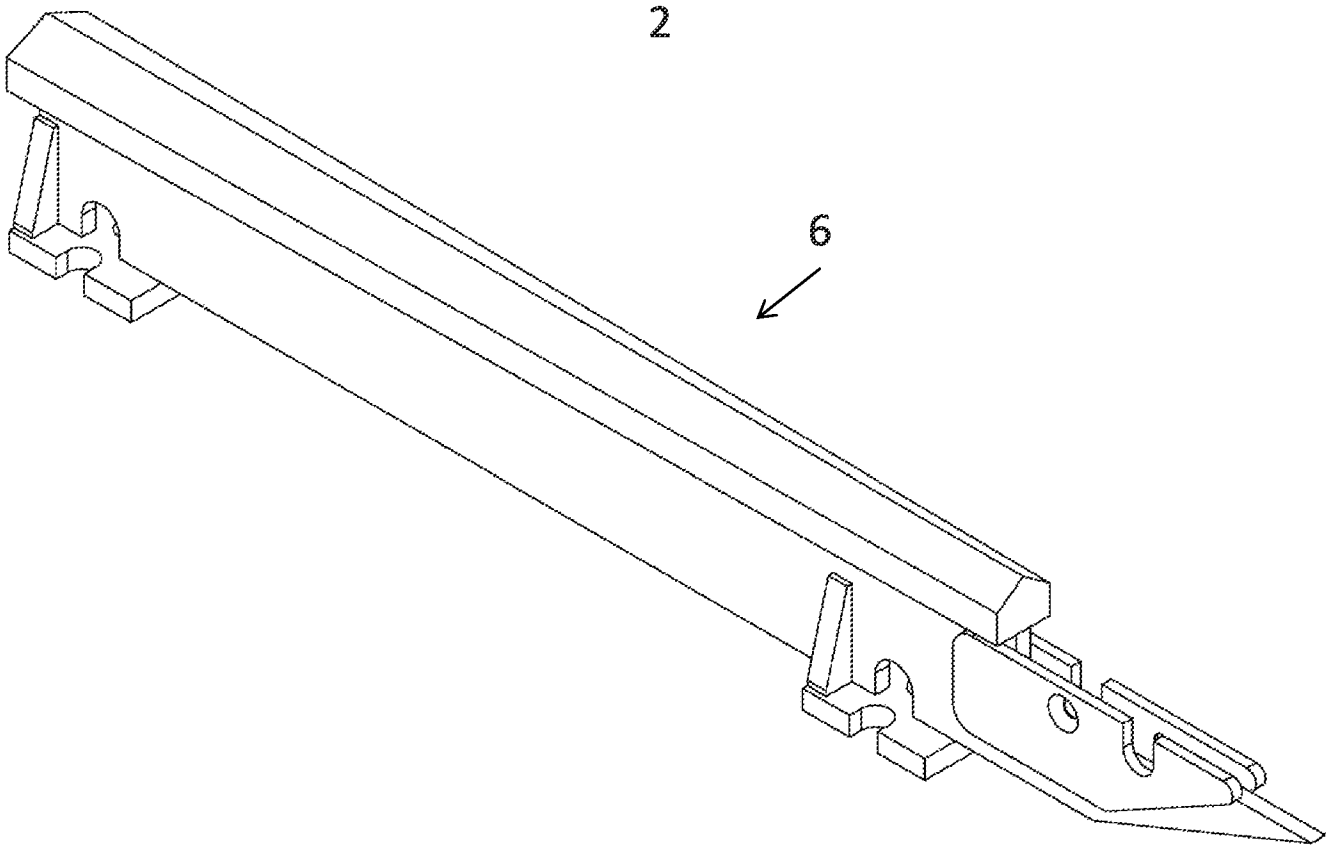
FIGS. 2B-2E are isometric views of alternate embodiments of the base component of a single grizzly screen member assembly.
Figure 2C:
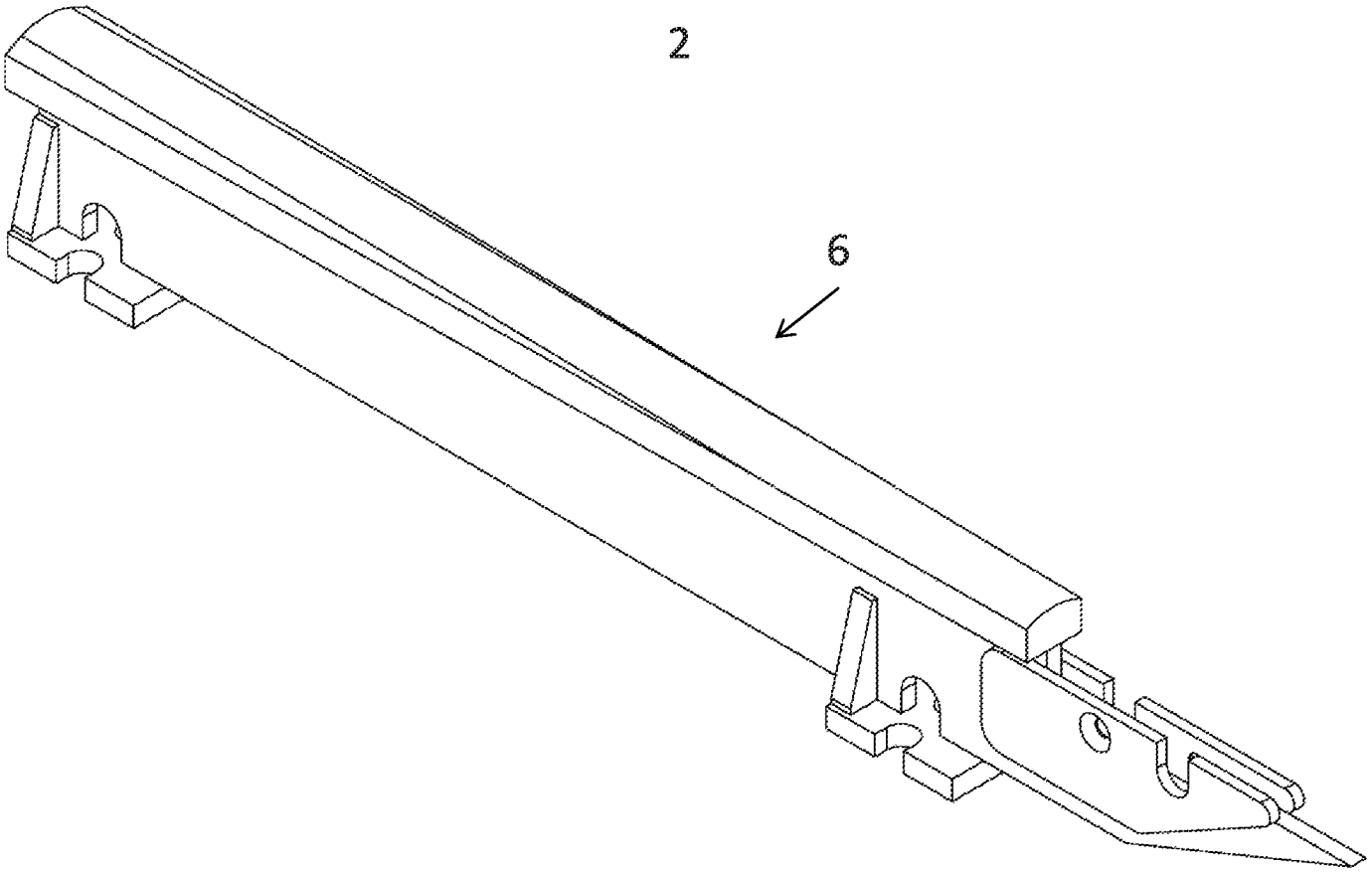
Figure 2D:
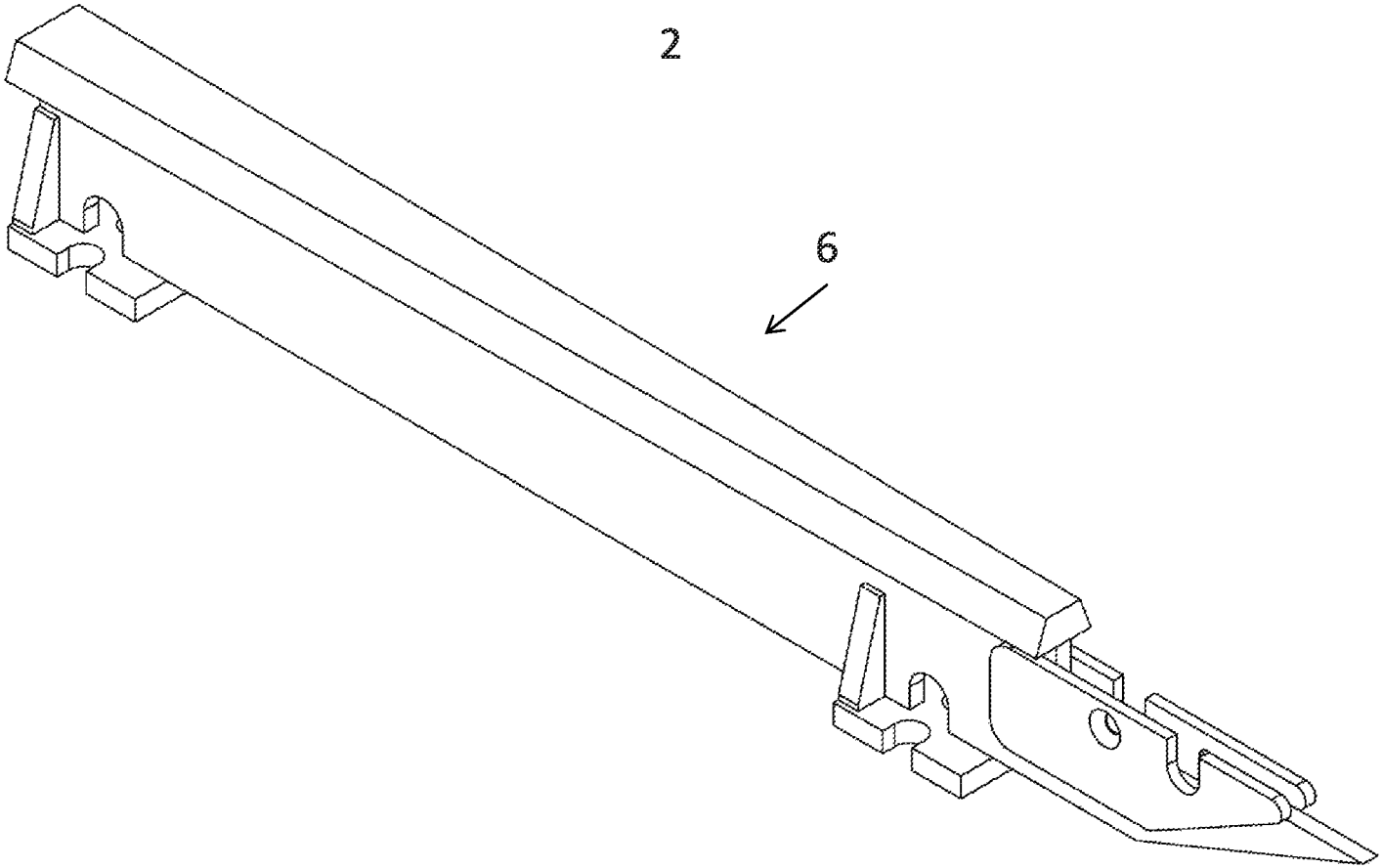
Figure 2E:
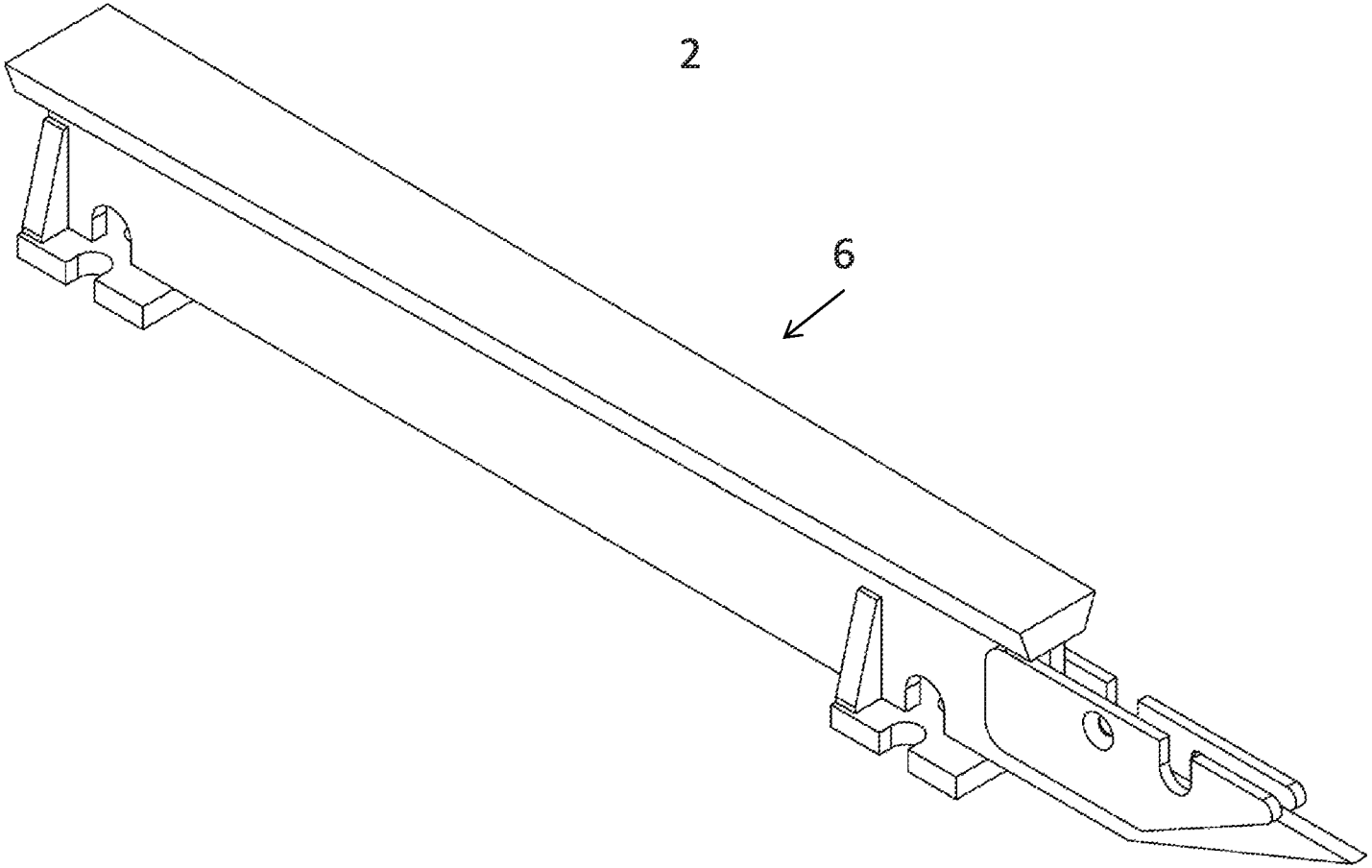

FIG. 2A is an isometric view of the base component 2 of a single grizzly screen member 1. The elongate base component 2 comprises several features integral to the structural integrity and functionality of the grizzly screen member assembly. The base component 2, features a top surface member 6 integrally coupled to the elongate base component 2. In one embodiment, the top surface member 6 is a rectangular prismatic member with a wear plate welded on top. The base component 2 also features mating support features 8 and 9. Mating support features 8 and 9 are coupled to the elongate base component 2 at a proximal and distal end of the elongate base component 2 respectively. In the embodiment displayed in FIG. 2A, by way of example, the mating support features 8 and 9 are made up of flat plates coupled to a bottom surface of the elongate base component 2 and triangular fillets between the top surfaces of the mating support features 8 and 9 and the elongate base component 2 to help support the elongate base component 2 withstand the force acted upon it by the grizzly feeder system. The mating support features 8 and 9 additionally comprise notches removed from the flat plates to allow for the base component 2 to be aligned and/or welded or bolted to the grizzly feeder system. The elongate base component 2 features notches horizontally through the member to allow tool access to placement bolts described above.

The mating support features 8 and 9 are not intended to be limited the structures described, but will be highly variable depending upon the grizzly feeder system to which the grizzly screen member is to be coupled. Alternative mating support features that allow for the grizzly screen member to be attached and detached from a grizzly feeder system are intended and contemplated by the present invention as well. For example, mating support feature 8 and 9 in one embodiment may be coupled to the grizzly feeder system frame itself. In this embodiment, the elongate base member 2 is secured into a slot created by a pair of mating features on the proximal and distal ends of the elongate base member 2.

Base component 2 also features an elongate member with a top surface extending in a longitudinal direction from the distal end of the base component 2. In this embodiment the height of the elongate member is less than the height of the elongate base component 2. At the top of the elongate member where the elongate member meets the elongate base component 2, a counter-lock slot 10 as further depicted in FIG. 4A extends longitudinally into the elongate base component 2 and prevents the replaceable tip component 3 from vertical rotation. A replaceable tip mating slot 11 is formed between replaceable tip support plates 12 and 13. The replaceable tip component 3 is disposed between the slot 11 to prevent the replaceable tip component 3 from rotating horizontally. The support plates 12 and 13 include replaceable tip fastening slots 14-17 to support a coupling such as but not limited to a nut and bolt 4 and 5 which act to secure the vertical passion of replaceable tip component 3 with in the grizzly screen member assembly 1.

In one embodiment, the inner surfaces facing the replaceable tip component 3 of the support plates 12 and 13, are tapered from the bottom of plates 12 and 13, towards the top of the plates such that the plates are configured to allow the replaceable tip component 3 to enter, but provide a slight compression fit at the bottom of the plates to provide additional support for the replacement component 3 in the assembly.

In another embodiment, the inner surfaces facing the replaceable tip component 3 of the support plates 12 and 13, are spaced and configured such to allow the replaceable tip component 3 to enter, but provide a slight compression fit throughout the plates to provide additional support for the replacement component 3 in the assembly.

FIG. 2B-2E show isometric views of various embodiments of the base component 2. These figures show the various geometrical configurations of the top surface member 6, and elongate base component 2. Different wear plate geometries are chosen depending on the application of the material being sorted by the grizzly feeder. The top surface member 6 and elongate base component 2 may be cast or forged as a single piece out of the same material, or the top surface member 6 and elongate base component 2 may be different materials with different hardness properties, integrally coupled to one another. For example the top surface member 6 may be comprised of chromium carbide, tungsten carbide or white iron chrome to resist wear, and welded onto the elongate base component 2 which may be a steel alloy that is designed to withstand fatigue from the cycling and vibration of the grizzly feeder. In this instance, the top surface member 6 may be thermally joined or welded onto a portion of elongate base component 2. It is noted that when top surface member 6 has an additional wear plated welded onto the top surface, it is best for the bead direction of the overlay material of the top surface member 6 to be perpendicular to the longitudinal direction of the grizzly screen member assembly 1. A perpendicular bead direction results in optimal wear life on the material between welds due to the nature of the forces acted upon overlay. The cross-section of the base component 2 is generally a t-configuration as shown in FIGS. 2B-2E to reduce the weight of the overall assembly.

Figure 3A:
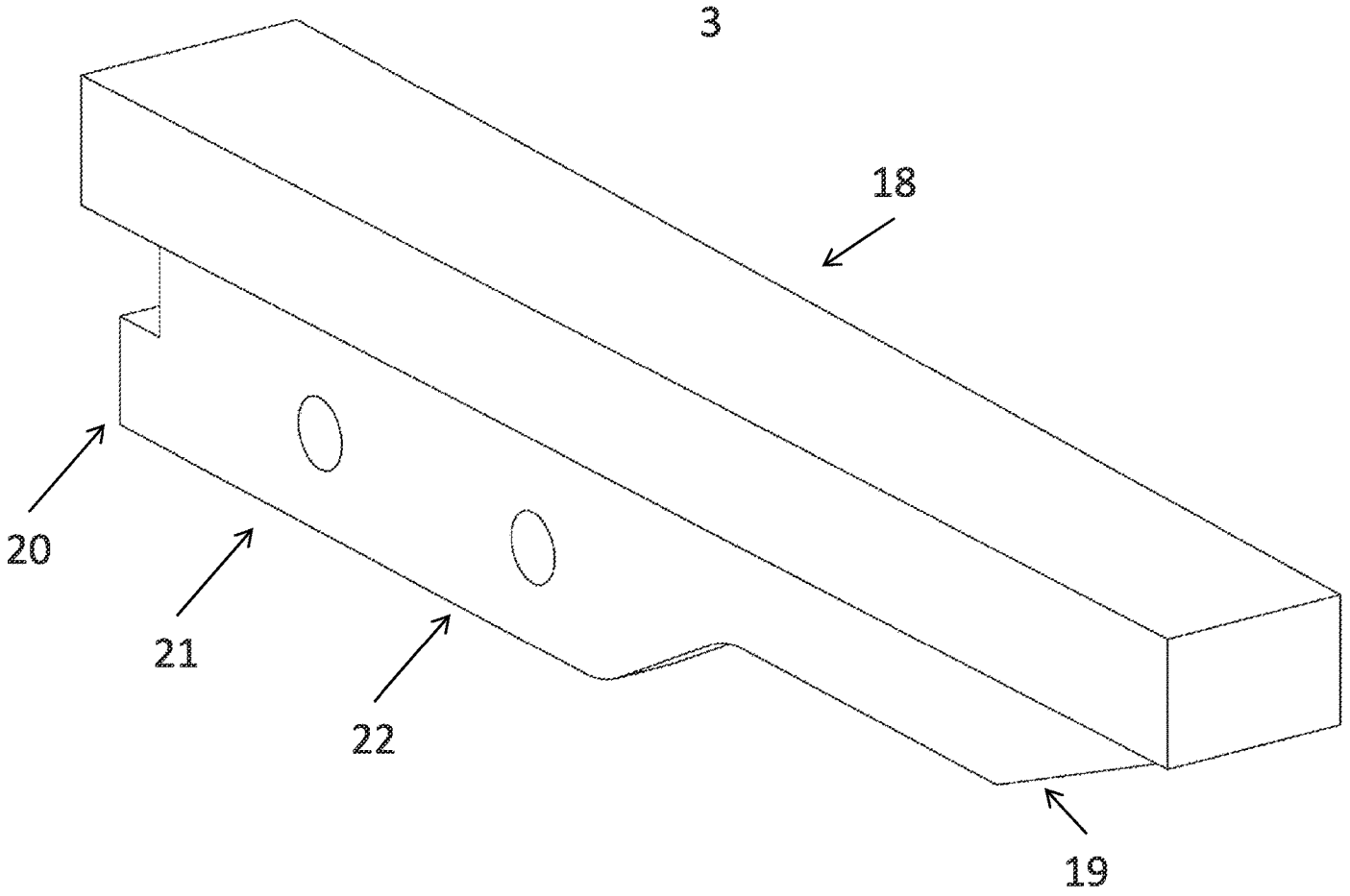
FIG. 3A is an isometric view of the replaceable tip component of a single grizzly screen member assembly.
Figure 3B:
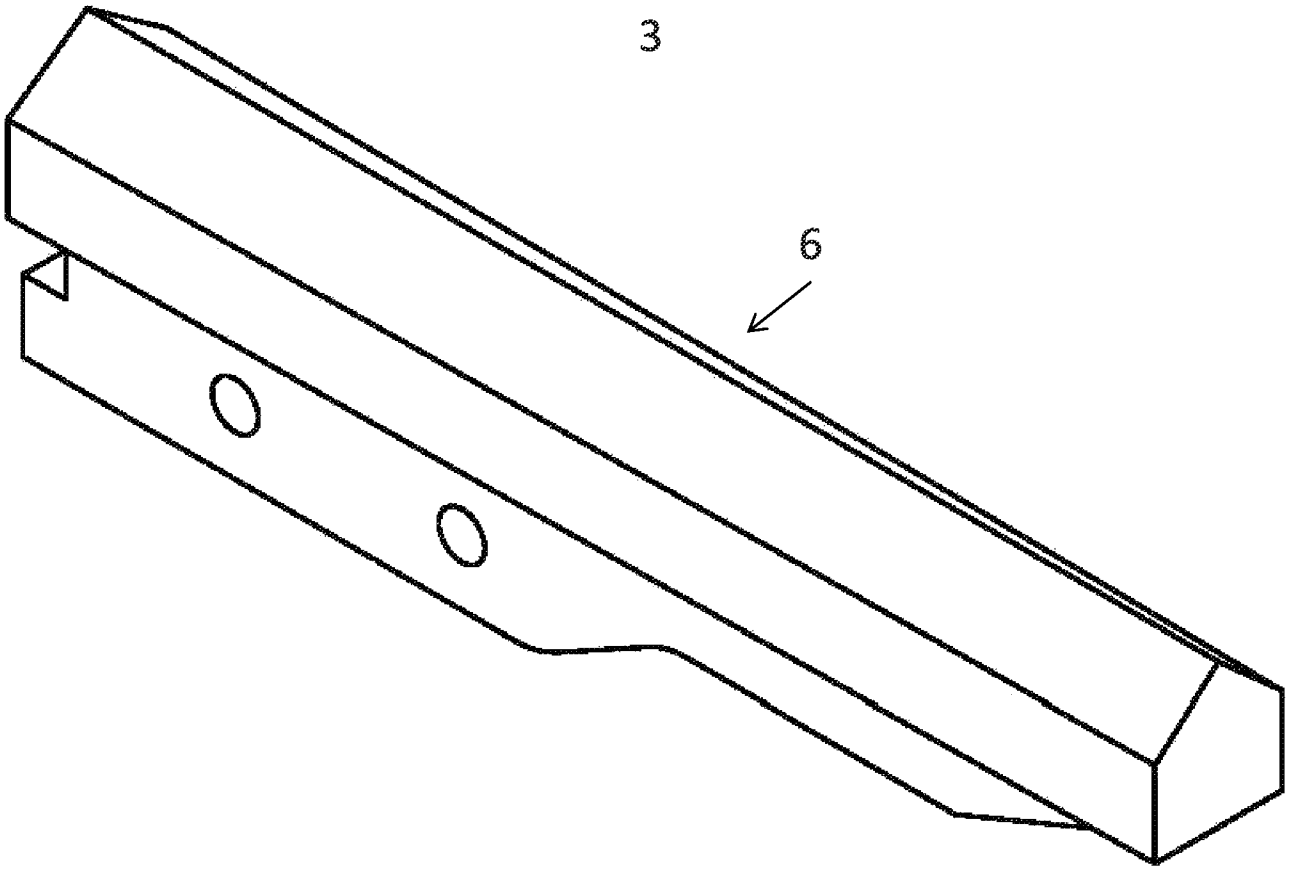
FIGS. 3B-3E are isometric views of alternate embodiments of the base component of a single grizzly screen member assembly.
Figure 3C:
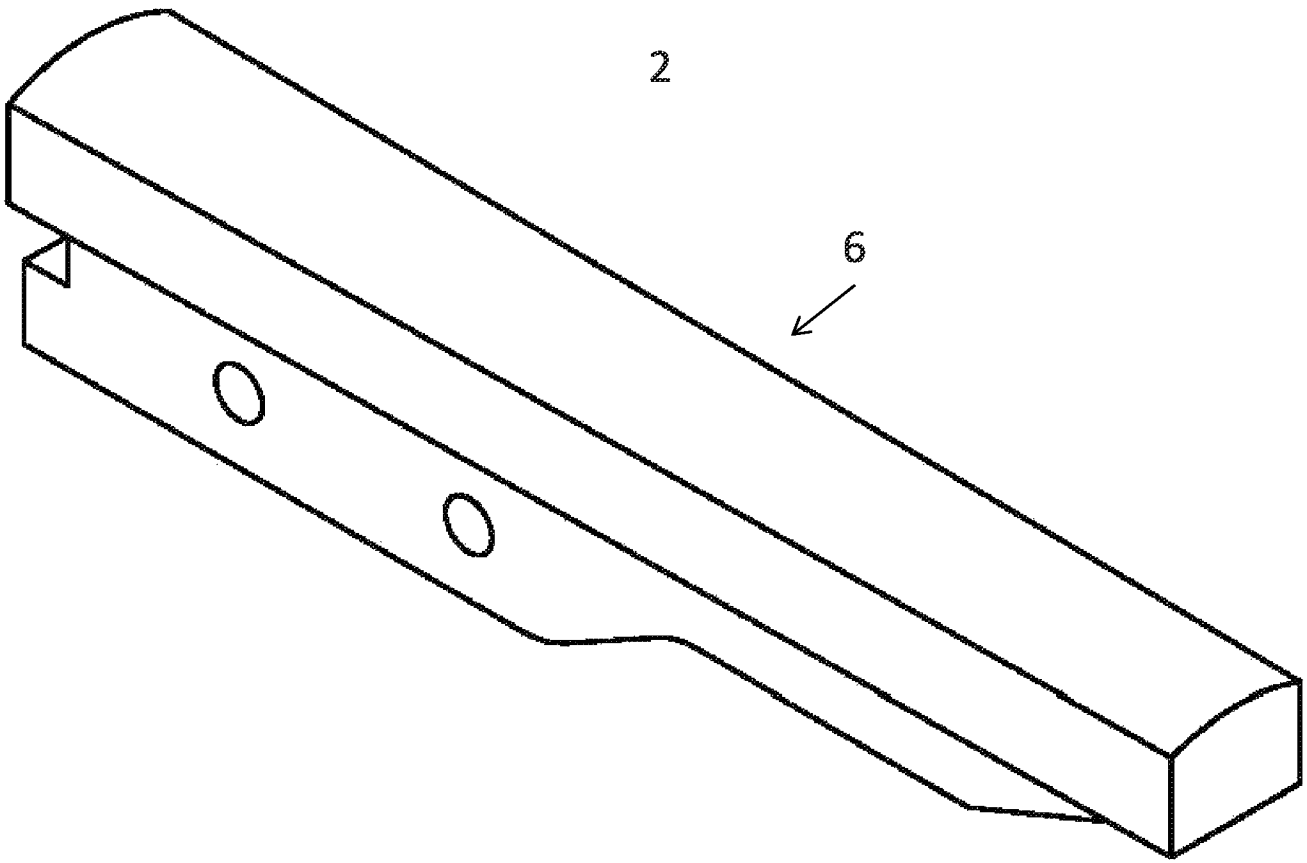
Figure 3D:
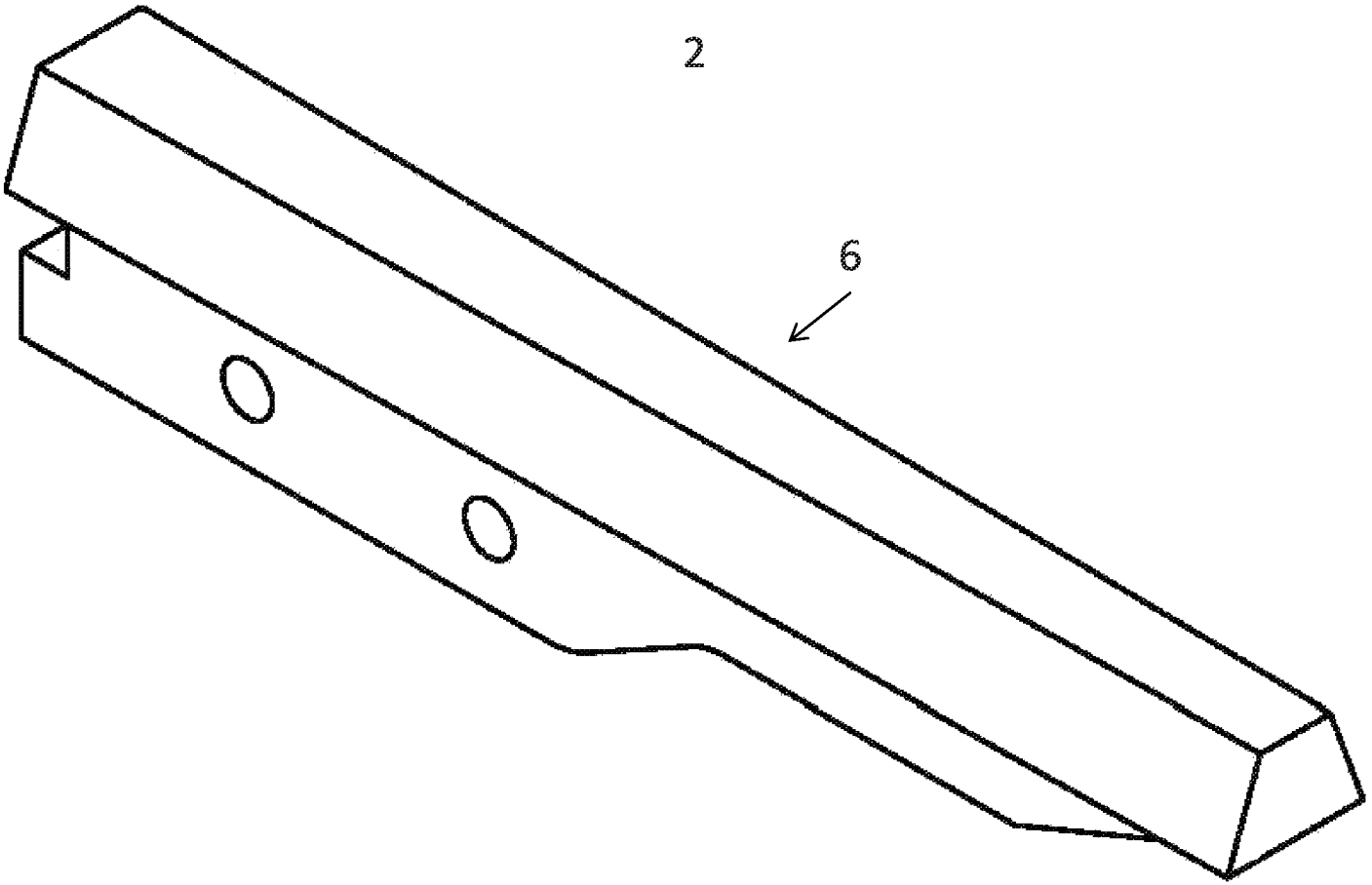
Figure 3E:
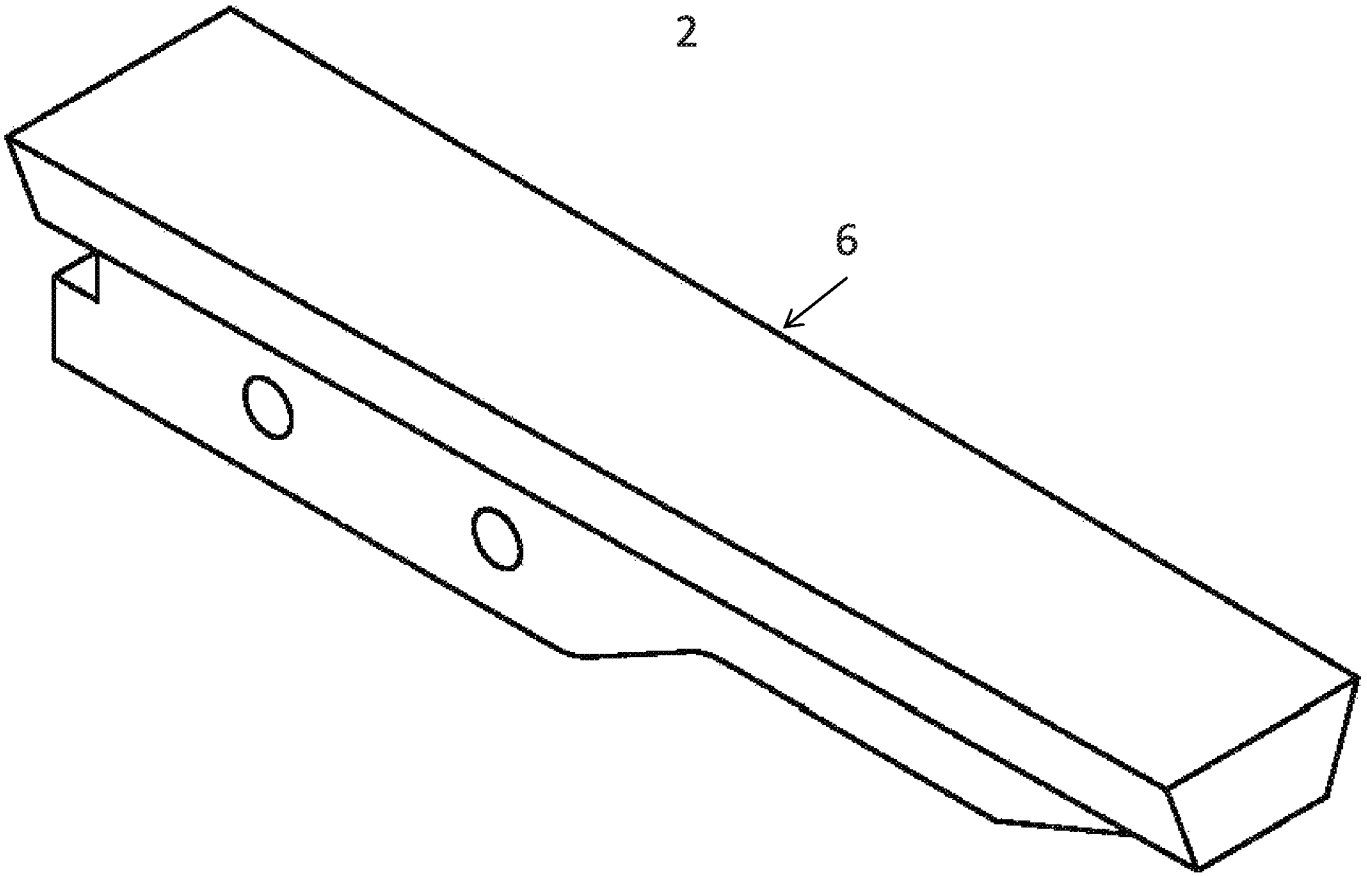

FIG. 3A is an isometric view of the replaceable tip component 3 of a single grizzly screen member assembly. The replaceable tip component 3 comprises several features integral to the structural integrity and functionality of the grizzly screen member assembly. The replaceable tip component 3, features a top tip surface member 18 integrally coupled the elongate replaceable tip component 3, an elongated counter-locking member 20 extending vertically from the base of the elongate replaceable tip component 3 and longitudinally from the elongate replaceable tip component 3, and fastening features 21 and 22 to allow the replacement tip component 3, to be fastened and secured between the replaceable tip support plates 12 and 13 of base component 2. The top tip surface member 18 is typically a support member with a wear plate welded on top of the elongate replaceable tip component 3 or a wear plate itself.

FIG. 3B-3E show isometric views of various embodiments of the base component 2. These figures show the various geometrical configurations of the top tip surface member 18, and elongate replaceable tip component 3. Different wear plate geometries are chosen depending on the application of the material being sorted by the grizzly feeder. The top tip surface member 18 and elongate replaceable tip component 3 may be cast or forged as a single piece out of the same material, or the top tip surface member 18 and elongate base component 2 may be different materials with different hardness properties, integrally coupled to one another. For example the top tip surface member 18 may be comprised of chromium carbide to resist wear, and welded onto the elongate replaceable tip component which may be a steel alloy that is designed to withstand fatigue from the cycling and vibration of the grizzly feeder. In this instance, the top tip surface member 18 may be thermally joined or welded onto a portion of elongate replaceable tip component 3. It is noted that when wear surface member 18 is welded to the elongate replaceable tip component 3, it is best for the bead direction of the overlay material of the top tip surface member 18 to be perpendicular to the longitudinal direction of the grizzly screen member assembly 1. A perpendicular bead direction results in optimal wear life on the material between welds due to the nature of the forces acted upon overlay. The cross-section of the base component 3 is generally a t-configuration as shown in FIGS. 3B-3E to reduce the weight of the overall assembly.

Figure 4A:
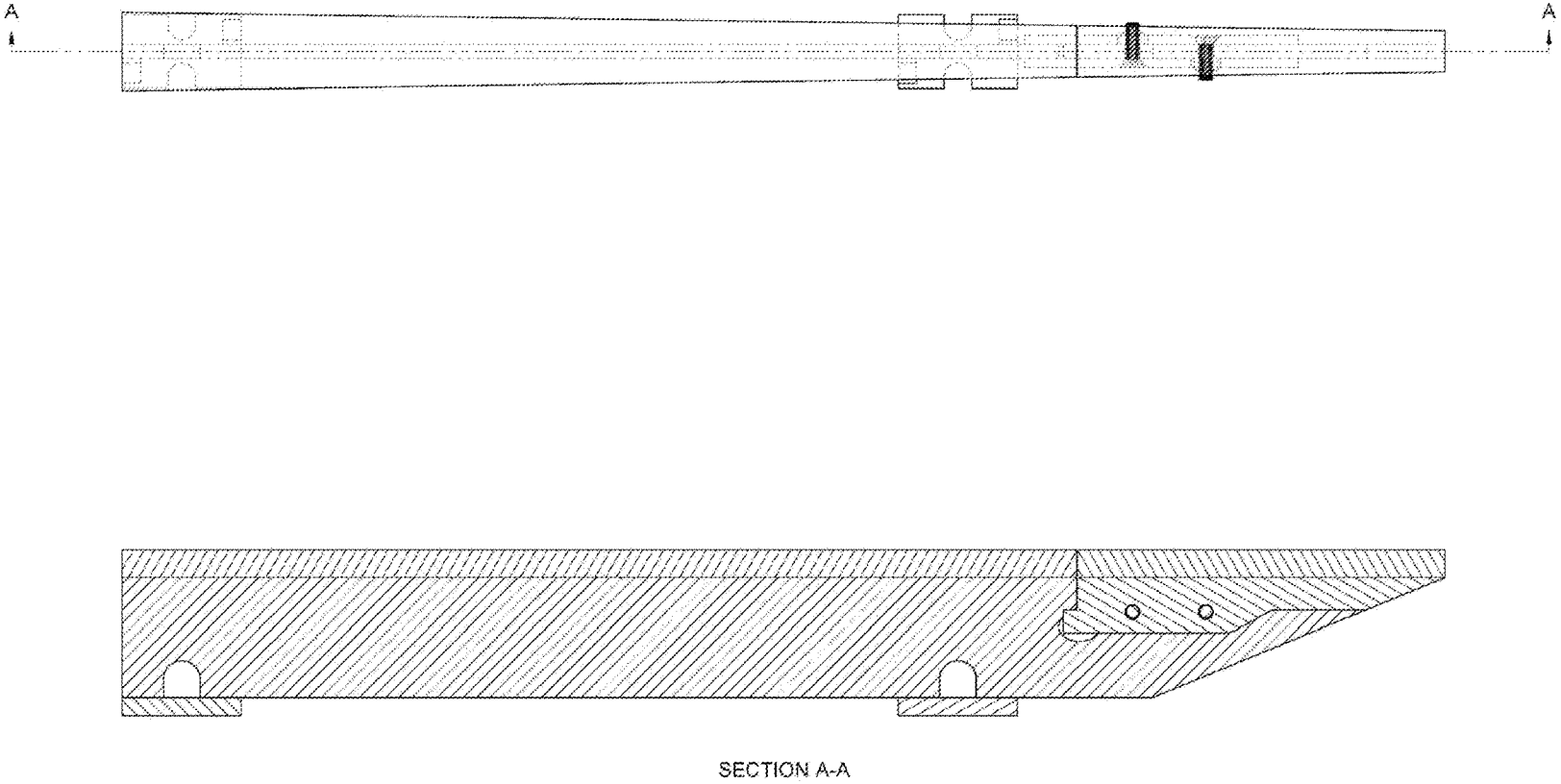
FIG. 4A is a cross-sectional right planar view of the a single grizzly screen member assembly.

FIG. 4A is a longitudinal cross-section of a single grizzly screen member assembly 1 further detailing the structural components arrangement described above. As shown in detail, the base of the elongated counter-locking member 20 mates the corresponding geometry of the counter-lock slot 9 of base member 2. The mating geometries prevent the replacement tip component 3 from rotating normal to the horizontal axis running through any of the fastening features 14-17 or 21-22 while due to forces acting on the system while the grizzly feeder is in operation.

Figure 4B:
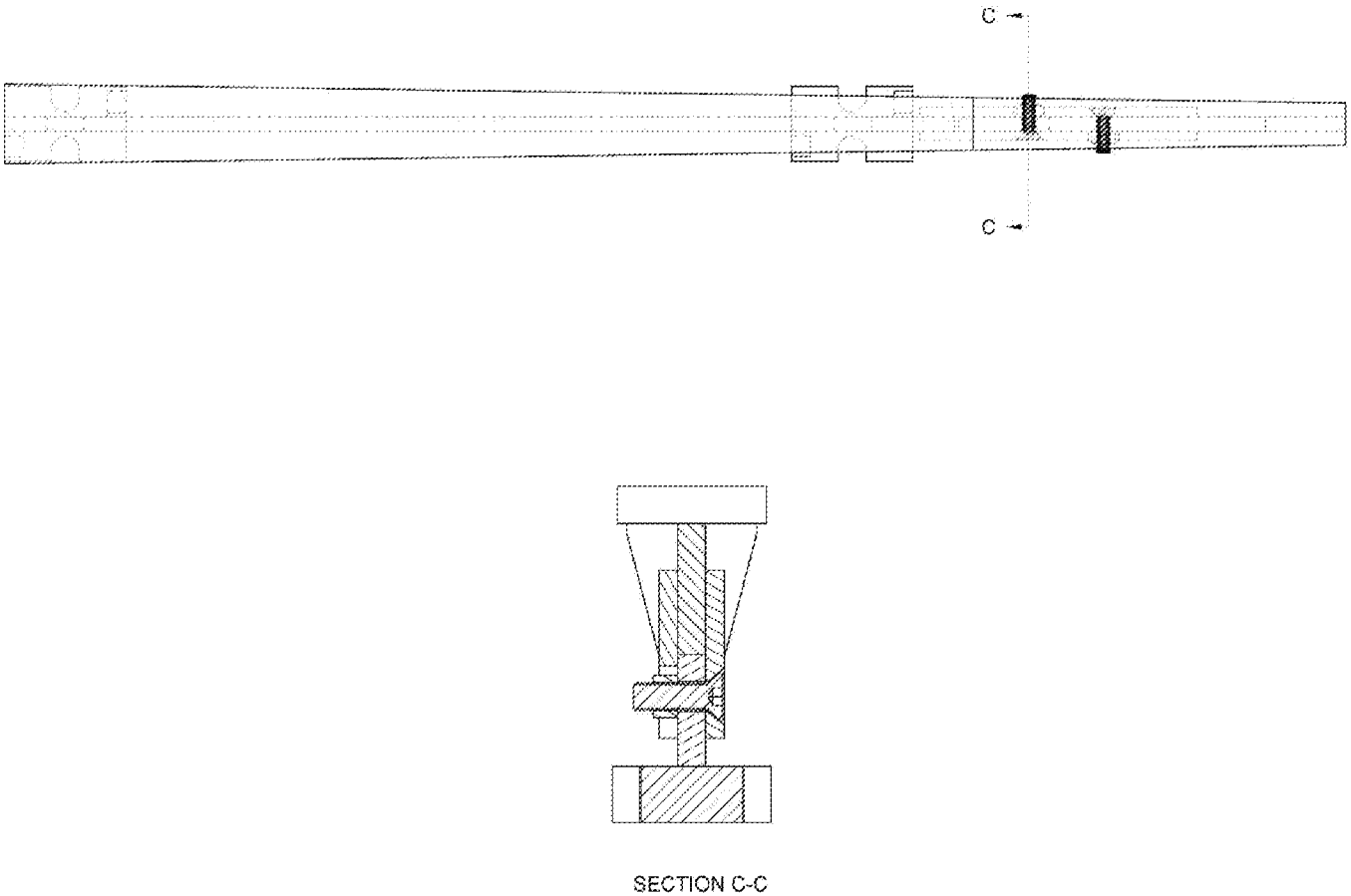
FIG. 4B is a horizontal cross-section of the grizzly screen member assembly along the central axis of base fastening hole.

FIG. 4B is a horizontal cross-section of the grizzly screen member assembly 1 along the central axis of base fastening hole 15. This view details the second tip structural member 19 disposed between the base component replacement tip support plates 12 and 13. The support plates 12 and 13 prevent lateral and rotational movement of the replacement tip component 3 due to forces created acting upon the system while the grizzly feeder is in operation. Also in this view, bolt 4 and locking nut 5 can be seen passing through the replacement tip support plates 12 and 13 and through the elongate replaceable tip component 3. The bolt 4 and locking nut 5 act to limit movement of the replacement tip component 3 in the vertical direction when acted on by forces while the grizzly feeder is in operation.

The present embodiment shows bolt 4 and locking nut 5 inset of top member and top tip member surfaces 6 and 18. Setting the bolt head 4 and nut 5 inset of the horizontal span of top member and top tip member surfaces 6 and 18 amounts to less wear on the bolt and nut combination caused by the media being filtered through the bars. Additionally the present embodiment comprises two fastening holes due to the particular length of the embodied assembly. Shorter length assemblies may require only one fastening hole, while longer length assemblies may require additional fastening holes.

Additional embodiments of a single grizzly screen member assembly 1 may be the combination of cross-sections and materials shown for the base component 2 and the replacement tip component 3. Because the wear patterns will vary by material, cross-section of the particular wear member and longitudinal location along the grizzly screen member assembly, the replacement tip component top tip surface member 18, may be comprised of a more expensive or heavier material than that of the base wear surface member 6. This creates the ability use vary replacement tips based on particular grizzly feeder application while reducing cost and increasing the life cycle of the grizzly screen member. For example depending on the specific wear patterns observed, the base component 2 of FIG. 2B may be combined with the replaceable tip component 3 of FIG. 3C.

Figure 5A:
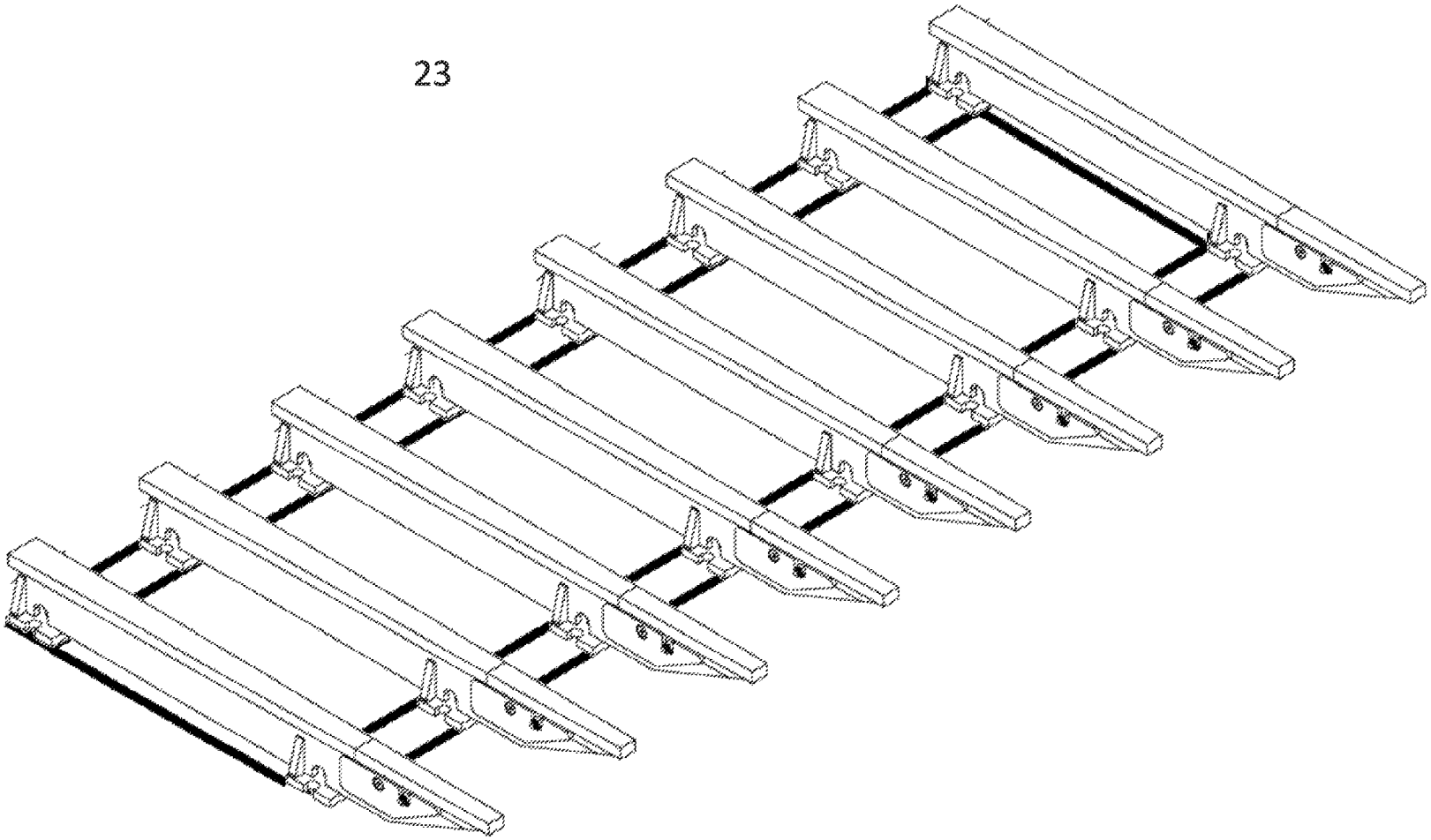
FIG. 5A is an isometric view of a panel assembly of multiple grizzly screen member assemblies.

FIG. 5A shows a series of grizzly screen member assemblies 1 installed onto a panel 23 for use in a grizzly feeder. As stated above, the replacement tip components 3 can be customized per the location of the individual grizzly screen member assemblies 1 within the panel 23. If additional wear is found in a particular bar assembly 1 location within a panel 23, a replacement tip component 3 with a more wear resistant top tip surface member 18, can be installed into that particular assembly to more evenly balance out wear within the system.

Figure 5B:
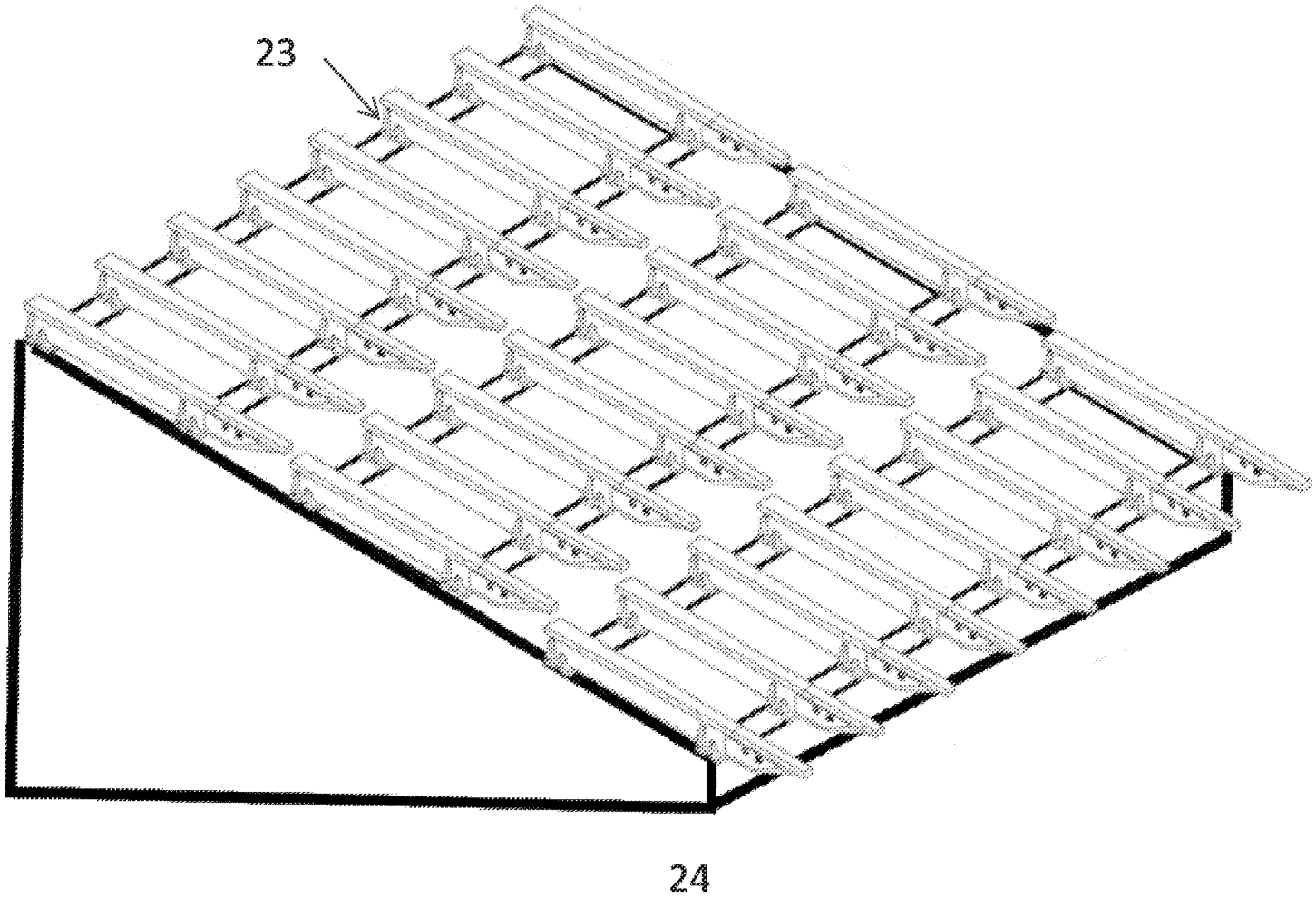
FIG. 5B of a grizzly feeder made of multiple panel assemblies of multiple grizzly screen member assemblies.

FIG. 5B shows a series of panels 23 installed onto a grizzly feeder 24. As stated above, the replacement tip components 3 can be customized per the location of the individual grizzly screen member assemblies 1 within the panels 23 and within the grizzly feeder 24. If additional wear is found in a particular bar assembly 1 location within a panel 23, a replacement tip component 3 with a more wear resistant top tip surface member 18, can be installed into that particular assembly to more evenly balance out wear within the system.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed:

1. A replaceable grizzly screen member assembly comprising:

a. an elongate base component with a proximal end, a distal end, a top surface member and a bottom surface, the base component further comprising an elongate member with a top surface extending longitudinally from the distal end of the base component and at least one support plate extending vertically from and coupled to the elongate member, the elongate member having a height less than a height of the base component and the base component further having a slot extending longitudinally into the distal end of the base component at the height of the elongate member;

b. an elongate replaceable tip component with a proximal end, a distal end, a top tip surface member, and a bottom tip surface;

c. a coupling; and d. the replaceable tip component being adapted to be removably coupled to the base component through the coupling.

2. The grizzly screen member assembly of claim 1, wherein the replaceable tip component comprises an elongate tip member extending longitudinally from the proximal end of the replaceable tip component at a distance less than the distance of the slot extending longitudinally into the base component, sharing a common bottom tip surface with the replaceable tip component.

3. The grizzly screen member assembly of claim 2, wherein the bottom tip surface is abutted against the top surface of the elongate member, the elongate tip member is disposed within the slot of base component, and the proximal end of the replaceable tip component is abutted against the distal end of the base component.

4. The grizzly screen member assembly of claim 3, wherein the at least one support plate comprises at least one hole or a slot extending horizontally through the at least one support plate, the replaceable tip component comprises at least one or slot extending horizontally through the replaceable tip component aligning with the at least one hole or slot of the at least one support plate, and the coupling means comprises at least one bolt and nut combination extending horizontally through the at least one support plate and through the replaceable tip component.

5. The grizzly screen member assembly of claim 1, wherein the top surface member and the top tip surface member are wear plates.

6. The grizzly screen member assembly of claim 5, wherein the top surface member and the top tip surface member are different materials.

7. The grizzly screen member assembly of claim 5, wherein the top surface member of the base component is a different material than the rest of the base component and the top tip surface member of the replaceable tip component is a different material than the rest of the replaceable tip component.

8. The grizzly screen member assembly of claim 5, wherein the top surface member and the tip top surface are thermally joined to the elongate base component and have a bead direction of an overlay material substantially perpendicular to the longitudinal direction of the elongate base component.

9. The grizzly screen member assembly of claim 5, wherein the top surface member of the base component and the top surface member of the replaceable tip components have different geometric cross sections.

10. The grizzly screen member assembly of claim 4, wherein the base component and the replaceable tip component each have a generally T-shaped cross section with the each respective top surfaces located at the top of the T.

11. The grizzly screen member assembly of claim 10, wherein the elongate member of the base component comprises at least one support plate on each lateral side of the elongated member of the base component, and the replaceable tip component is disposed between the two at least one support plate on each lateral side.

12. A grizzly feeder system with replaceable grizzly screen member assemblies comprising:

a. at least one replaceable grizzly screen member comprising an elongate base component with a proximal end, a distal end, a top surface member and a bottom surface, wherein the bottom surface is coupled to the grizzly feeder at the proximal and distal ends of the base component, the base component further comprising an elongate member with a top surface extending longitudinally from the distal end of the base component and at least one support plate extending vertically from and integrally coupled to the elongate member, the elongate member having a height less than a height of the base component and the base component further having a slot extending longitudinally into the distal end of the base component at the height of the elongate member;

b. the at least one replaceable grizzly screen member further comprising an elongate replaceable tip component with a proximal end, a distal end, a top tip surface member and a bottom tip surface;

c. a coupling between the elongate base component and the replaceable tip component; and d. the replaceable tip component removably coupled to the base component through the coupling.

13. The grizzly feeder system of claim 12, wherein the at least one replaceable grizzly screen member is coupled to a panel which is integrally to the grizzly feeder.

14. The grizzly screen member assembly of claim 13, wherein the top surface member and the top tip surface member are wear plates.

15. The grizzly feeder system of claim 14, wherein the top surface member and the top tip surface member are different materials.

16. The grizzly feeder system of claim 14, wherein the top surface member is a different material than the rest of the base component.

17. The grizzly feeder system of claim 14, wherein the top tip surface is a different material than the rest of the replaceable tip component.

18. A method for using a replaceable grizzly screen member assembly to replace the tip of a grizzly member comprising:

a. at least one replaceable grizzly screen member comprising an elongate base component with a proximal end, a distal end, a top surface member and a bottom surface, wherein the bottom surface is coupled to a grizzly feeder at the proximal and distal ends of the base component, the base component further comprising an elongate member with a top surface extending longitudinally from the distal end of the base component and at least one support plate extending vertically from and coupled to the elongate member, the elongate member having a height less than a height of the base component and the base component further having a slot extending longitudinally into the distal end of the base component at the height of the elongate member, the at least one replaceable grizzly screen member further having an elongate replaceable tip component removably coupled to the base component;

b. decoupling the replaceable tip component;

c. removing the replaceable tip component;

d. replacing the replaceable tip component with a second replaceable tip component; and e. coupling the second replaceable tip component to the base component.

* * * * *